US009676015B2

(12) United States Patent
Inoue et al.

(10) Patent No.: US 9,676,015 B2
(45) Date of Patent: Jun. 13, 2017

(54) COMPOSITE ROLLING MILL ROLL AND ROLLING METHOD

(71) Applicant: Nippon Steel & Sumitomo Metal Corporation, Tokyo (JP)

(72) Inventors: Tsuyoshi Inoue, Tokyo (JP); Shigeru Uchida, Tokyo (JP); Seiji Ito, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 314 days.

(21) Appl. No.: 14/397,921

(22) PCT Filed: Jul. 8, 2013

(86) PCT No.: PCT/JP2013/068619
§ 371 (c)(1),
(2) Date: Oct. 30, 2014

(87) PCT Pub. No.: WO2014/010547
PCT Pub. Date: Jan. 16, 2014

(65) Prior Publication Data

US 2015/0089987 A1 Apr. 2, 2015

(30) Foreign Application Priority Data

Jul. 9, 2012 (JP) ..... 2012-153880

(51) Int. Cl.
*B21B 1/26* (2006.01)
*B21B 27/02* (2006.01)
(Continued)

(52) U.S. Cl.
CPC ..... *B21B 27/02* (2013.01); *B21B 27/03* (2013.01); *B22F 3/15* (2013.01); *B22F 7/08* (2013.01);
(Continued)

(58) Field of Classification Search
CPC ..... B21B 27/03; B21B 27/02; B21B 27/032; B21B 27/035; B21B 2267/24; B22F 3/15;
(Continued)

(56) References Cited

U.S. PATENT DOCUMENTS

2006/0035082 A1 2/2006 Hattori et al.
2015/0089987 A1* 4/2015 Inoue ..... B21B 27/03 72/199

FOREIGN PATENT DOCUMENTS

CN 101716656 6/2010
CN 102069093 5/2011
(Continued)

OTHER PUBLICATIONS

International Search Report dated Oct. 1, 2013 issued in corresponding PCT Application No. PCT/JP2013/068619 [with English Translation].
(Continued)

*Primary Examiner* — David B Jones
(74) *Attorney, Agent, or Firm* — Birch, Stewart, Kolasch & Birch, LLP

(57) ABSTRACT

A composite rolling mill roll according to the present invention includes: a steel roll shaft; and an outer layer provided around the roll shaft, in which the outer layer includes a sintered body including a base metal which is an iron alloy, a fibrous inclusion which consists of a ceramic and has an average diameter of 1 to 30 μm and an average aspect ratio of 10 to 500, and a particulate inclusion which consists of a ceramic and has an average diameter of powder 1 to 100 μm, an amount of the fibrous inclusion is 5 to 40 volume % relative to the volume of the sintered body, and an amount of the particulate inclusion is 5 to 30 volume % relative to the volume of the sintered body.

21 Claims, 2 Drawing Sheets

(51) Int. Cl.

| | |
|---|---|
| ***B21B 27/03*** | (2006.01) |
| ***B22F 7/08*** | (2006.01) |
| ***C22C 47/14*** | (2006.01) |
| ***C22C 49/08*** | (2006.01) |
| ***B22F 3/15*** | (2006.01) |
| *C22C 33/02* | (2006.01) |

(52) U.S. Cl.
CPC ..... *C22C 47/14* (2013.01); *C22C 49/08* (2013.01); *B21B 27/032* (2013.01); *B21B 27/035* (2013.01); *B21B 2267/24* (2013.01); *B21B 2267/26* (2013.01); *C22C 33/0257* (2013.01)

(58) Field of Classification Search
CPC . B22F 7/08; C22C 47/14; C22C 49/08; C22C 33/0257
See application file for complete search history.

(56) References Cited

FOREIGN PATENT DOCUMENTS

| | | |
|---|---|---|
| CN | 102765952 | 11/2012 |
| CN | 102766824 | 11/2012 |
| JP | 63-282295 | 11/1988 |
| JP | 01-230736 | 9/1989 |
| JP | 01-252561 | 10/1989 |
| JP | 02-205656 | 8/1990 |
| JP | 03-068724 | 3/1991 |
| JP | 04-072034 | 3/1992 |
| JP | 04-314930 | 11/1992 |
| JP | 07-166291 | 6/1995 |
| JP | 11-028508 | 2/1999 |
| JP | 11-061349 | 3/1999 |
| JP | 2001-059147 | 3/2001 |
| JP | 2003-119554 | 4/2003 |
| JP | 2004-010969 | 1/2004 |
| JP | 2004181521 | 7/2004 |
| JP | 2004-243338 | 9/2004 |
| JP | 2008-069403 | 3/2008 |
| JP | 4320699 | 8/2009 |

OTHER PUBLICATIONS

Office Action dated Apr. 15, 2014 issued in corresponding Japanese Application No. 2013-556933 [with English Translation].
Office Action dated Jul. 3, 2015 issued in corresponding Chinese Application No. 201380022793.0, [with English Translation].
Extended European Search Report dated Jan. 18, 2016 issued in corresponding European Application No. 13817167.3.

* cited by examiner

COMPOSITE ROLLING MILL ROLL AND ROLLING METHOD

TECHNICAL FIELD OF THE INVENTION

This application is a national stage application of International Application No. PCT/JP2013/068619, filed Jul. 8, 2013, which claims priority to Japanese Patent Application No. 2012-153880, filed on Jul. 9, 2012, each of which is incorporated by reference in its entirety.

The present invention relates to a composite rolling mill roll used in a rolling among manufacturing of a metal product such as steel; and a rolling method. In particular, the present invention relates to a composite rolling mill roll used in hot rolling; and a rolling method.

RELATED ART

For a rolling mill roll used in a rolling, a high-hardness material in which ceramic components such as a carbide are dispersed in a metal matrix is used. Typically, such a rolling mill roll is manufactured with a casting method. By adjusting components or optimizing heat treatment conditions or the like, a material having the strength and hardness required to be used as a rolling mill roll can be manufactured.

Meanwhile, as a rolling mill roll manufactured with a method other than a casting method, rolling mill rolls formed of fiber reinforced metals (FRM) are known, the FRM being reinforced by being manufactured using a combination of powder particles used to form a metal matrix with a ceramic fiber and a sintering method (Patent Documents 1, 2, and 4). In addition, a rolling mill roll obtained with such a method for manufacturing is also known to have higher wear resistance, seizing resistance, and resistance of deterioration for roll surface than those of a rolling mill roll manufactured with a casting method. In addition, a rolling mill roll which is reinforced by adding ceramic powder particles to powder particles used to form a metal matrix is known (Patent Document 3). However, these techniques disclosed in these documents have problems described below.

Patent Document 1 relates to a composite rolling mill roll in which an outer layer formed of a wear-resistant material is provided around a steel shaft. This outer layer formed of a wear-resistant material is manufactured by adding small pieces of a ceramic fiber to a powder of an iron alloy and sintering the obtained mixture. However, the present inventors found that, by adding a large amount of ceramic fiber to a roll outer layer, the surface roughness of a roll may be increased, and the strength of the roll outer layer may be decreased to cause cracking in the roll outer layer. The present inventors found that, when 45 volume % of small pieces of a ceramic fiber is added to a powder of an iron alloy to form a roll outer layer, material defects such as cracking occur in the roll outer layer. Such findings are not disclosed in Patent Document 1.

Patent Document 2 relates to a metal which is reinforced by adding a ceramic fiber thereto. This metal in which the ceramic fiber is added is manufactured by sintering a mixture of a metal powder and the ceramic fiber. Patent Document 2 discloses that, during the sintering, the internal pressure of a sintering furnace is necessarily 0.1 to 7.0 MPa which is a relatively low pressure. However, the ceramic-fiber-added metal sintered under such a pressure is not suitable for an outer layer of a rolling mill roll to which a large load is applied during use. This is because a sintered material to which a sufficient pressure is not applied during sintering contains a large number of voids, and these voids cause cracking when a large load is applied to the sintered body. In order to be used for an outer layer of a rolling mill roll, it is necessary that the ceramic-fiber-added metal be sintered by hot isostatic pressing (HIP) under a high pressure.

Patent Document 3 relates to an outer layer of a rolling mill roll which is manufactured by mixing a powder of an iron alloy with SiC particles or $B_4C$ particles and sintering the obtained mixed powder. However, SiC and $B_4C$ are not preferable as a component of the ceramic powder which is mixed with the powder of the iron alloy. This is because SiC and $B_4C$ react with iron to form an alloy during sintering. The formed alloy inhibits the strength of a sintered metal from being improved by the addition of a ceramic. The present inventors verified that, when powders of SiC and $B_4C$ are mixed with a powder of an iron alloy, a sintered body obtained from the mixed powder does not have sufficient strength for an outer layer of a rolling mill roll.

Patent Document 4 relates to a rolling mill roll as a composite member structure including an outer layer that is formed by mixing a powder of an iron-base metal, in which a carbide having 10 μm or less of a diameter crystallizes, with small pieces of an oxide ceramic fiber and sintering the obtained mixture. In the rolling mill roll, a theoretical density of the outer layer is increased to be higher than or equal to 99% with a sintering method. However, when the theoretical density is higher than or equal to 99%, microdefects initiated by aggregation of a ceramic fiber cannot be completely removed from the outer layer. In addition, when a rolling mill roll including the outer layer is used for rolling, propagation of microcracks caused by the microdefects is unavoidable. Due to the propagation of the microcracks, there is a problem in that material lacking occurs on a surface of the rolling mill roll, and the surface of the rolling mill roll is deteriorated.

PRIOR ART DOCUMENT

Patent Document

[Patent Document 1] Japanese Unexamined Patent Application, First Publication No. H11-28508

[Patent Document 2] Japanese Unexamined Patent Application, First Publication No. 2003-119554

[Patent Document 3] Japanese Unexamined Patent Application, First Publication No. H11-061349

[Patent Document 4] Japanese Unexamined Patent Application, First Publication No. 2001-59147

DISCLOSURE OF THE INVENTION

Problems to be Solved by the Invention

Along with improvement of rolling such as an increase in the rolling amount of a high-strength steel and increase in rolling speed, conditions of the usage environment of a rolling mill roll have became more severe, and further improvement of wear resistance and resistance of deterioration for roll surface is required in the rolling mill roll. In order to improve these properties, it is considered that the amount of ceramic components in an outer layer of a composite rolling mill roll be increased. However, according to the findings by the present inventors, in a composite rolling mill roll (FRM rolling mill roll) in which FRM is used as an outer layer, when a blending amount of a ceramic fiber is increased to increase the amount of ceramic components, ceramic fibers are intertwined with each other, and defects are likely to occur by fiber aggregation during the manufacturing of the FRM rolling mill roll. As a result, it is difficult to manufacture a robust roll. However, when a composite rolling mill roll having the same blending amount of a ceramic as that of the FRM rolling mill roll is manufactured using only a powder of an iron alloy and a ceramic powder, the ceramic powder functions as a propagation path of cracks, and thus cracks are likely to be propagated. The present inventors found that, when a sintered body is manufactured by blending a ceramic powder into a powder of an iron alloy, the performance of a composite rolling mill roll can be improved by further blending a ceramic fiber into the powder of the iron alloy to suppress the propagation of cracks caused by the ceramic powder. In addition, as a result of further study, the present inventors found that, by blending both a ceramic fiber and a ceramic powder into a powder of an iron alloy, the amount of ceramic components in a sintered body of an outer layer of a composite rolling mill roll can be increased without the propagation of cracks caused by the aggregation of the ceramic fiber and the ceramic powder.

An object of the present invention is to provide a composite rolling mill roll having higher properties than those of a FRM rolling mill roll of the related art, in which both of tribological properties such as wear resistance and resistance of deterioration for roll surface and mechanical properties such as cracking resistance and strength, which are required in a composite rolling mill roll, are satisfied.

Means for Solving the Problem

In order to solve the above-described problems, the following invention is provided.

(1) According to a first aspect of the present invention, there is provided a composite rolling mill roll including: a steel roll shaft, and an outer layer provided around the roll shaft, in which the outer layer includes a sintered body including a base metal which is an r, a fibrous inclusion which consists of a ceramic and has an average diameter of 1 to 30 μm and an average aspect ratio of 10 to 500, and a particulate inclusion which consists of a ceramic and has an average diameter of powder of 1 to 100 μm, an amount of the fibrous inclusion is 5 to 40 volume % relative to a volume of the sintered body, and an amount of the particulate inclusion is 5 to 30 volume % relative to the volume of the sintered body.

(2) In the composite rolling mill roll according to (1), a chemical composition of the base metal of the sintered body may include: 0.8 to 3.5 wt % of C; 1 to 13 wt % of Cr; 0 to 18 wt % of Mo; 0 to 28 wt % of W; 0 to 15 wt % of Ni; 0 to 18 wt % of Co; 2 to 20 wt % of one or more of elements in total, the elements being selected from a group consisting of V, Nb, Ti, Ta, Zr, and Hf; and a remainder including Fe and an impurity.

(3) In the composite rolling mill roll according to (1) or (2), the particulate inclusion and the fibrous inclusion may be one or more of an oxide, a nitride, and a carbide.

(4) In the composite rolling mill roll according to (3), the particulate inclusion may be one or more of an alumina, a zirconia, a titania, a boron nitride, a silicon nitride, and a zirconium nitride.

(5) In the composite rolling mill roll according to (3) or (4), the fibrous inclusion may be one or more of the alumina, a mullite, the boron nitride, and the silicon nitride.

(6) In the composite rolling mill roll according to one of (1) to (5), a total amount of the particulate inclusion and the fibrous inclusion may be 35 to 70 volume % relative to the volume of the sintered body.

(7) According to a second aspect of the present invention, there is provided a composite rolling mill roll including: a steel roll shaft; and an outer layer provided around the roll shaft, in which the outer layer includes a sintered body obtained by sintering a mixture of (a) a powder of an iron alloy, (b) a ceramic fiber which has an average diameter of 1 to 30 μm and an average aspect ratio of 10 to 500, and (c) a ceramic powder which has an average diameter of powder of 1 to 100 μm, a blending amount of (b) the ceramic fiber before the sintering is 5 to 40 volume % relative to a total amount of (a) the powder of the iron alloy, (b) the ceramic fiber, and (c) the ceramic powder before the sintering, a blending amount of (c) the ceramic powder before the sintering is 5 to 30 volume % relative to the total amount of (a) the powder of the iron alloy, (b) the ceramic fiber, and (c) the ceramic powder before the sintering, and (b) the ceramic fiber and (c) the ceramic powder exist independently after the sintering.

(8) In the composite rolling mill roll according to (7), a chemical composition of (a) the powder of the iron alloy before the sintering may include: 0.8 to 3.5 wt % of C; 1 to 13 wt % of Cr; 0 to 18 wt % of Mo; 0 to 28 wt % of W; 0 to 15 wt % of Ni; 0 to 18 wt % of Co; 2 to 20 wt % of one or more of elements in total, the elements being selected from a group consisting of V, Nb, Ti, Ta, Zr, and Hf; and a remainder including Fe and an impurity.

(9) In the composite rolling mill roll according to (7) or (8), (c) the ceramic powder may be one or more of an oxide, a nitride, and a carbide.

(10) In the composite rolling mill roll according to (9), (c) the ceramic powder may be one or more of an alumina, a zirconia, a titania, a boron nitride, a silicon nitride, and a zirconium nitride.

(11) In the composite rolling mill roll according to one of (7) to (10), (b) the ceramic fiber may be one or more of an oxide-type fiber, a carbide-type fiber, and a nitride-type fiber.

(12) In the composite rolling mill roll according to one of (7) to (11), a total blending amount of (b) the ceramic fiber and (c) the ceramic powder before the sintering may be 35 to 70 volume % relative to the total amount of (a) the powder of the iron alloy, (b) the ceramic fiber, and (c) the ceramic powder before the sintering.

(13) According to a third aspect of the present invention, there is provided a method for rolling including: rolling a metallic material with the composite rolling mill roll according to one of (1) to (12).

(14) According to a fourth aspect of the present invention, there is provided a method for manufacturing a composite rolling mill roll including an outer layer and a roll shaft, the method including: mixing a powder of an iron alloy, a ceramic powder having 1 to 100 μm of an average diameter of powder, and a ceramic fiber having 1 to 30 μm of an average diameter and 10 to 500 of an average aspect ratio to obtain a raw mixture; and filling the raw mixture into a tubular capsule installed around the roll shaft, then degassing inside of the capsule, and then sintering the raw mixture by hot isostatic pressing under 70 to 120 MPa of a pressure to obtain the composite rolling mill roll in which the outer layer is joined around the roll shaft, in which a blending amount of the ceramic fiber before the sintering is 5 to 40 volume % relative to the total amount of the raw mixture before the sintering, and a blending amount of the ceramic powder before the sintering is 5 to 30 volume % relative to the total amount of the raw mixture before the sintering.

Effects of the Invention

According to the composite rolling mill roll of the present invention, as compared to a FRM rolling mill roll of the related art (which is formed of a composite of a powder of an iron alloy and a ceramic fiber, or a composite of a powder of an iron alloy and a ceramic powder), the wear resistance and the resistance of deterioration for roll surface are improved, and the cracking resistance can be maintained at the same level as that of the FRM rolling mill roll of the related art. As a result, when the composite rolling mill roll is used in a rolling, the life of the composite rolling mill roll can be increased, the replacement cycle of the composite rolling mill roll can be significantly increased, and not only improvement in unit consumption of a roll but improvement in productivity and yield can be expected.

EMBODIMENTS OF THE INVENTION

Figure 1:
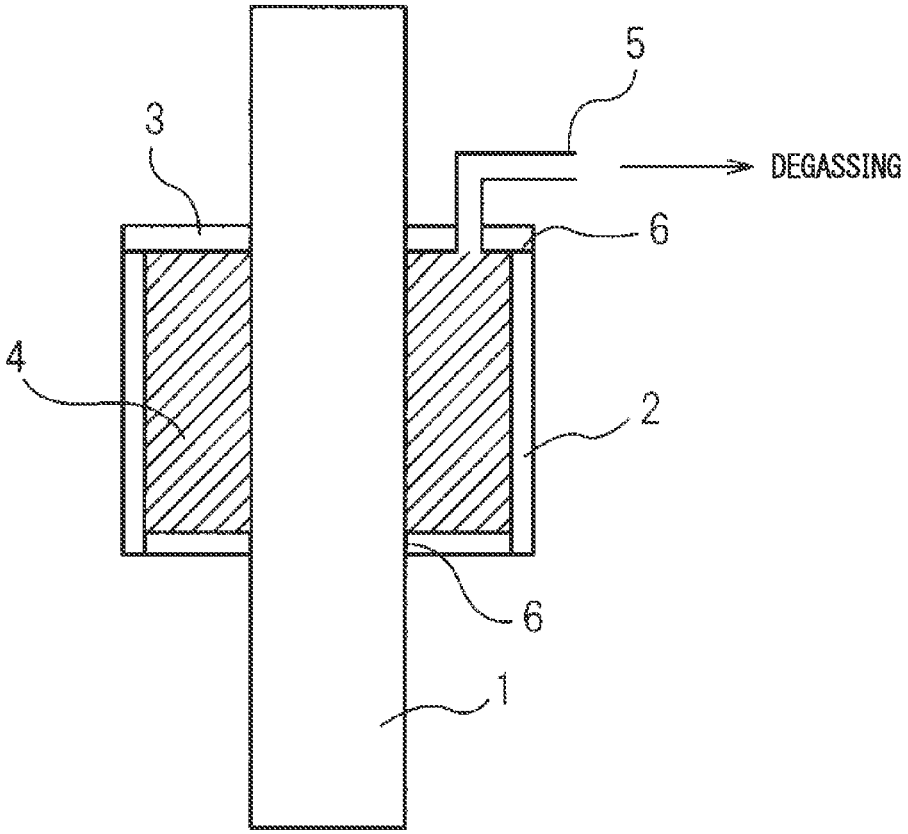
FIG. 1 is a diagram illustrating a simultaneous sintering method which uses a hot isostatic pressing.

A composite rolling mill roll according to an embodiment of the present invention is a composite roll in which an outer layer is provided outside (around) the steel roll shaft (core). The outer layer is concentrically provided around the roll shaft, and the thickness thereof is typically about 10 mm to 100 mm. An intermediate layer may be formed between the roll shaft and the outer layer. The outer layer contains a sintered body which is obtained by sintering a mixture of (a) a powder of an iron alloy, (b) a ceramic fiber, and (c) a ceramic powder.

It is preferable that the powder of the iron alloy according to the present embodiment includes: 0.8 to 3.5 wt % of C; 1 to 13 wt % of Cr; 0 to 18 wt % of Mo; 0 to 28 wt % of W; 0 to 15 wt % of Ni; 0 to 18 wt % of Co; 2 to 20 wt % of one or more of elements selected from a group consisting of V, Nb, Ti, Ta, Zr, and Hf; and a remainder including Fe and an impurity. It is more preferable that the powder of the iron alloy according to the present embodiment contain: 1.0 to 2.8 wt % of C; 2 to 10 wt % of Cr; 0 to 15 wt % of Mo; 0 to 20 wt % of W; 0 to 10 wt % of Ni; 0 to 15 wt % of Co; 3 to 15 wt % of one or more of elements selected from a group consisting of V, Nb, Ti, Ta, Zr, and Hf; and a remainder including Fe and an impurity. Hereinafter, the reason for providing the chemical composition of the powder of the iron alloy will be described.

(C: 0.8 to 3.5 wt %)

C is contained to form a carbide. The preferable upper limit of the C content is 3.5 wt %, and the preferable lower limit thereof is 0.8 wt %. When the C content is less than the lower limit, the amount of precipitated carbide may be small, and the wear resistance of the sintered body may not be sufficiently secured. When the C content is greater than the upper limit, the carbide may not be uniformly dispersed in the sintered body, which may cause a problem in the toughness and the resistance of deterioration for roll surface of the sintered body. The C content is more preferably 1.0 to 2.8 wt %.

(Cr: 1 to 13 wt %)

Cr forms a Cr-based carbide and contributes improvement in the wear resistance of the sintered body. In order to obtain the effect, the Cr content is preferably 1 to 13 wt %. When the Cr content is greater than the upper limit, the crystallization amount of a Cr-based carbide may be excessively increased, and the toughness and the cracking resistance may be decreased. When the Cr content is less than the lower limit, the hardenability may be decreased. The Cr content is more preferably 2 to 10 wt %.

(Mo: 0 to 18 wt %)

(W: 0 to 28 wt %)

In order to improve the hardenability and the high-temperature hardness of the sintered body, it is preferable that Mo and W be contained in the sintered body. Further, W may be contained as an element used to form a carbide. In order to obtain the effect, the Mo content is preferably 0 to 18 wt %, and the W content is preferably 0 to 28 wt %. When the Mo content and the W content are greater than the upper limits, the toughness and the resistance of deterioration for roll surface of the sintered body may deteriorate. The Mo content is more preferably 0 to 15 wt %. The W content is more preferably 0 to 20 wt %.

(Ni: 0 to 15 wt %)

(Co: 0 to 18 wt %)

Ni is an element used to improve hardenability. In order to obtain the effect, the Ni content is preferably 0 to 15 wt %. When the Ni content is greater than the upper limit, the amount of residual austenite in the sintered body may be increased, and cracking and deterioration for roll surface during rolling may be likely to occur. By Co being contained, advantageous effects are obtained in resistance to temper softening and secondary hardening. In order to obtain the effects, the Co content is preferably 0 to 18 wt %. When the Co content is greater than the upper limit, the hardenability may deteriorate. The Ni content is more preferably 0 to 10 wt %. The Co content is more preferably 0 to 15 wt %.

(One or More of Elements Selected from a Group Consisting of V, Nb, Ti, Ta, Zr, and Hf: 2 to 20 wt %)

V, Nb, Ti, Ta, Zr, and Hf form a MC carbide and contribute to improvement in wettability between the melted iron alloy and the ceramic fiber. Further, V, Nb, Ti, Ta, Zr, and Hf form a pro-precipitated carbide (carbide crystallized in crystal grains) and consume C. As a result, the crystallization amount of a secondary precipitated carbide (carbide crystallized in grain boundaries) which is formed by binding between C and Mo, Cr, or W is decreased. A carbide crystallized in grain boundaries may be distributed in the sintered body in a network shape and may form a crack propagation path, which may decrease the toughness and the resistance of deterioration for roll surface of the sintered body. In order to obtain the effects, the total amount of one or two or more elements selected from a group consisting of V, Nb, Ti, Ta, Zr, and Hf is preferably 2 to 20 wt %. When the total amount of one or two or more elements selected from a group consisting of V, Nb, Ti, Ta, Zr, and Hf is less than 2 wt %, the crystallization amount of a MC carbide may be small, and the improvement of the wear resistance may be insufficient. Moreover, a secondary precipitated carbide may be likely to be crystallized in a network shape, which may adversely affect the toughness and the resistance of deterioration for roll surface. In addition, when the total amount of the elements is greater than the upper limit, a large pro-precipitated carbide may be crystallized, which may cause deterioration for roll surface. The total amount of one or two or more elements selected from a group consisting of V, Nb, Ti, Ta, Zr, and Hf is more preferably 3 to 15 wt %.

The powder of the iron alloy according to an aspect of the present embodiment contains the above-described components and a remainder including Fe and an impurity. For example, the impurity is impurities contained in raw materials such as ore or scrap and impurities contained during manufacturing.

The powder of the iron alloy contains a carbide ceramic component. When the powder of the iron alloy is converted into the sintered body, this carbide ceramic component improves the strength, the toughness, and the hardness of the sintered body of the iron alloy to a sufficient level as a composite rolling mill roll. However, a sintered body which is obtained using only the powder of the iron alloy does not have sufficient performance as a composite rolling mill roll. In order to impart sufficient performance to a sintered body, it is necessary that the ceramic fiber and the ceramic powder are mixed with the powder of the iron alloy to increase the ceramic content in the sintered body.

(Average Diameter of Powder of Iron Alloy: 1 to 100 μm)

The average diameter of the powder of the iron alloy is 1 to 100 μm. When the average diameter of the powder of the iron alloy is less than 1 μm, powders of the iron alloy may aggregate with each other, and it may be difficult to sufficiently suppress void defects during sinter molding. On the other hand, when the average diameter of the powder of the iron alloy is greater than 100 μm, there is a concern that gaps between ceramic portions derived from the ceramic powder and the ceramic fiber, which are arranged around the powder of the iron alloy by being mixed with the powder of the iron alloy, may be excessively widened. In this case, the properties of the sintered body such as wear resistance, seizing resistance, and resistance of deterioration for roll surface may deteriorate. The preferable average diameter of the powder of the iron alloy is 5 to 50 μm.

In the present embodiment, the term "the average diameter of the powder of the iron alloy" refers to the diameter (median size) of an intermediate value (cumulative value: 50%) in a cumulative diameter distribution curve which is measured with a laser diffraction scattering method. As a measuring device, for example, SALD-3100 manufactured by Shimadzu Corporation is used.

In the composite rolling mill roll according to the present embodiment, the blending amount of (b) the ceramic fiber before sintering is 5 to 40 volume % relative to the total amount of (a) the powder of the iron alloy, (b) the ceramic fiber, and (c) the ceramic powder before sintering, and the blending amount of (c) the ceramic powder before sintering is 5 to 30 volume % relative to the total amount of (a) the powder of the iron alloy, (b) the ceramic fiber, and (c) the ceramic powder before sintering.

(Blending Amount of Ceramic Fiber Before Sintering: 5 to 40 volume %)

When the blending amount of the ceramic fiber before sintering is less than 5 volume %, the wear resistance, the resistance of deterioration for roll surface, and the cracking resistance required for the composite rolling mill roll are not sufficiently obtained. On the other hand, when the blending amount of the ceramic fiber before sintering is greater than 40 volume %, ceramic fibers are intertwined with each other and fiber aggregation occurs. This fiber aggregation causes voids during sinter forming Due to these voids, it is difficult to sufficiently suppress material defects. Further, when the blending amount of the ceramic fiber before sintering is greater than 40 volume %, the resistance of deterioration for roll surface of the roll deteriorates. This is because micro-void-like defects occur by aggregation of fiber. The blending amount of the ceramic fiber before sintering is preferably 10 to 30 volume %.

(Blending Amount of Ceramic Powder Before Sintering: 5 to 30 Volume %)

When the blending amount of the ceramic powder before sintering is less than 5 volume %, the effects of improving the properties such as wear resistance, seizing resistance, and resistance of deterioration for roll surface are not obtained as compared to a composite rolling mill roll of the related art obtained by compositing only (b) the ceramic fiber and (a) the powder of the iron alloy. On the other hand, when the blending amount of the ceramic powder before sintering is greater than 30 volume %, the mechanical properties such as toughness and cracking resistance, which are required when the sintered body is used as an outer layer of a composite rolling mill roll cannot be sufficiently ensured.

(Total Blending Amount of Ceramic Fiber and Ceramic Powder Before Sintering: 35 to 70 Volume %)

The total blending amount of (b) the ceramic fiber and (c) the ceramic powder before sintering is preferably 35 to 70 volume %. As a result, in the sintered body, more preferably than the techniques of the related art, the mechanical properties such as toughness and cracking resistance which are required for a composite rolling mill roll can be ensured, and the tribological properties such as wear resistance and resistance of deterioration for roll surface can be improved. When the total blending amount is less than 35 volume %, it may be difficult to improve the tribological properties such as wear resistance and resistance of deterioration for roll surface as compared to the techniques of the related art. When the total blending amount is greater than 70 volume %, the mechanical properties such as toughness and cracking resistance which are required for a composite rolling mill roll may not be ensured. Further, in order to sufficiently exhibit the effects of the present embodiment, it is preferable that the total blending amount of (b) the ceramic fiber and (c) the ceramic powder before sintering is 40 to 60 volume %.

(Component of Ceramic Powder: One or More of Oxide, Nitride, and Carbide)

It is preferable that the ceramic powder be one or more elements selected from an oxide, a nitride, and a carbide. As the oxide, for example, an alumina, a zirconia, or a titania is preferably used. As the nitride, for example, a boron nitride, a silicon nitride, a zirconium nitride, or a titanium nitride, is preferably used. As the carbide, for example, a vanadium carbide, a chromium carbide, or a titanium carbide is preferably used.

However, among carbides, a silicon carbide (SiC) and a boron carbide ($B_4C$) are not appropriate as the ceramic powder according to the present embodiment. This is because SiC and $B_4C$ react with Fe in the powder of the iron alloy to form an alloy during sintering. When the alloy is formed, the addition effects of these ceramic powders deteriorate, and the wear resistance of the roll deteriorates. The present inventors verified that, when powders of SiC and $B_4C$ are mixed with a ceramic fiber and a powder of an iron alloy, a sintered body obtained from a mixed powder does not have sufficient wearing resistance as a material of an outer layer of a composite rolling mill roll even though the strength is slightly improved as compared to a case where the powders are not added. However, when another metal is coated on the surfaces of the powders of SiC and $B_4C$ by means of PVD, plating, or the like, this coating inhibits the reaction of SiC and $B_4C$ with Fe, and thus, SiC and $B_4C$ can exhibit a capability of improving the strength and the wear resistance of the sintered body. Accordingly, it is necessary that the ceramic powder according to the present embodiment exists independently after sintering. The expression "exist independently" implies that there is substantially no case where the ceramic powder reacts with a surrounding base metal to form a compound.

(Average Diameter of Ceramic Powder: 1 to 100 μm)

The average diameter of the ceramic powder is 1 to 100 μm. When the average diameter of the ceramic powder is less than 1 μm, ceramic powders aggregate with each other, and it may be difficult to sufficiently suppress void defects during sinter molding. In order to reliably prevent the aggregation of the ceramic powder portions, the lower limit of the average diameter of the ceramic powder may be 2 μm, greater than 2 μm, 5 μm, 15 μm, or 20 μm. On the other hand, when the average diameter of the ceramic powder is greater than 100 μm, and when the obtained sintered body is used as a composite rolling mill roll a particulate inclusion in the sintered body caused by the ceramic powder may function as a propagation path, and the mechanical properties of the composite rolling mill roll may deteriorate. In the present embodiment, it is preferable that a ceramic powder having an average diameter of 3 to 50 μm be used.

The limitation of a powder shape by an aspect ratio is less common in this technical field and the powder technology field. Typically, the term "powder" refers to a particle having an aspect ratio of about 1 to 2 (when the shape of a powder is oval-spherical, the ratio expressed by a quotient of long diameter/short diameter). However, in the present embodiment, the specific numerical value of the aspect ratio of the ceramic powder is not limited.

In the present embodiment, the term "the average diameter of the ceramic powder" refers to the diameter (median size) of an intermediate value (cumulative value: 50%) in a cumulative diameter distribution curve which is measured with a laser diffraction scattering method. As a measuring device, for example, SALD-3100 manufactured by Shimadzu Corporation is used.

(Component of Ceramic Fiber: One or More of Oxide, Nitride, and Carbide)

It is preferable that the ceramic fiber be one or more of an oxide-type fiber, a carbide-type fiber, and a nitride-type fiber. As the oxide-type fiber, the carbide-type fiber, or the nitride-type fiber, for example an alumna fiber, a mullite fiber, a boron nitride fiber, a silicon nitride fiber, or a $SiBN_3C$ fiber is preferably used.

However, a silicon carbide (SiC) and a boron carbide ($B_4C$) cannot be used as a component of the ceramic fiber according to the present embodiment. The reason is the same as the reason why these compounds cannot be used as a component of the ceramic powder according to the present embodiment. However, when another metal is coated on the surfaces of the fibers of SiC and $B_4C$ by means of PVD, plating, or the like, SiC and $B_4C$ can exhibit a capability of improving the strength and the wear resistance of the sintered body. Accordingly, it is necessary that the ceramic fiber according to the present embodiment exist independently after sintering.

(Shape of Ceramic Fiber: 1 to 30 μm of Average Diameter, 10 to 500 of Average Aspect Ratio)

The average diameter of the ceramic fiber is 1 to 30 μm and preferably 3 to 15 μm. When the average diameter of the ceramic fiber is less than 1 μm, fibers are intertwined with each other during manufacturing, and void-like defects unavoidably occur. On the other hand, when the average diameter of the ceramic fiber is greater than 30 μm, the surface roughness of the composite rolling mill roll is increased with the use of the composite rolling mill roll as a rolling mill roll, and deterioration for roll surface is likely to occur due to the generation of excessive frictional heat.

The average aspect ratio of the ceramic fiber is 10 to 500 and more preferably about 30 to 300. When the average aspect ratio of the ceramic fiber is less than 10, the ceramic fiber cannot exhibit a function of fiber reinforcement. That is, only substantially the same effects as those of a method for manufacturing in which only ceramic particles are mixed with a powder of an iron alloy are obtained, and the effects obtained by mixing the ceramic fiber and the ceramic powder cannot be obtained. In this case, as in the case where a FRM rolling mill roll is manufactured using only a powder of an iron alloy and a ceramic powder, there is a concern that the ceramic fiber functions as a propagation path of cracks and cracks are likely to be propagated. On the other hand, when the average aspect ratio of the ceramic fiber is greater 500, fibers are likely to be intertwined with each other, and void-like defects unavoidably occur.

In the present embodiment, the average diameter and the average aspect ratio of the ceramic fiber are obtained by the following means. First, 50 or more fiber portions are randomly selected. Next, the fiber portions are observed with a microscope to measure the diameters and lengths thereof. Then, the arithmetic mean values of these measured values are obtained. The arithmetic mean value of the diameters of the ceramic fiber is the average diameter of the ceramic fiber, and a value obtained by dividing the arithmetic mean value of the lengths of the ceramic fiber by the arithmetic mean value of the diameters of the ceramic fiber is the average aspect ratio of the ceramic fiber.

As described above, the composite rolling mill roll according to the present embodiment contains (a) the powder of the iron alloy, (b) the ceramic fiber, and (c) the ceramic powder. The ceramic in the sintered body manufactured by the sinter forming of the mixed powder includes a ceramic derived from the ceramic powder and the ceramic fiber which are mixed as raw materials; and further includes a carbide which is derived from the components of the powder of the iron alloy and is precipitated or crystallized in portions derived from the powder of the iron alloy in the sintered body. The carbide which is precipitated or crystallized in portions derived from the powder of the iron alloy is necessary to secure the strength, the toughness, and the hardness of the sintered body which is obtained by the sinter forming of the powder of the iron alloy. In the present embodiment, the sintered body includes the carbide which is precipitated or crystallized in portions derived from the powder of the iron alloy and further includes the ceramic derived from the ceramic fiber and the ceramic powder. As a result, a composite rolling mill roll having higher tribological properties such as wear resistance and resistance of deterioration for roll surface and higher mechanical properties, such as cracking resistance and strength, than those of the related art can be realized.

Figure 2:
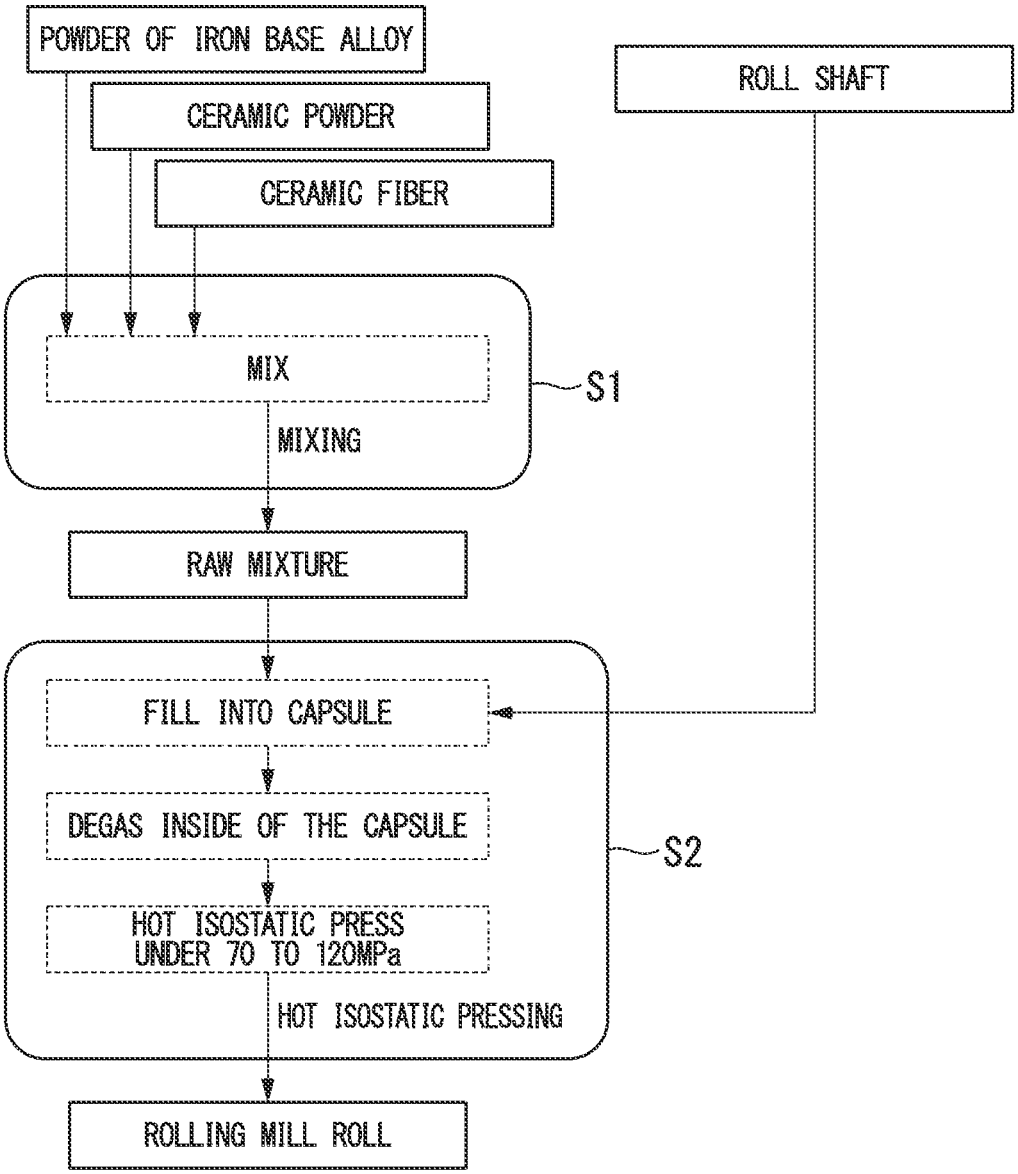
FIG. 2 is a flow chart illustrating a method for manufacturing a composite roll.

The composite rolling mill roll according to the present embodiment can be manufactured with the following method illustrated in FIG. 2. That is, a composite rolling mill roll in which an outer layer is provided around a roll shaft can be obtained by:

(1) mixing (a) a powder of an iron alloy, (b) a ceramic powder having 1 to 100 μm of an average diameter, and (c) a ceramic fiber having an average diameter of 1 to 30 μm and an average aspect ratio of 10 to 500 to obtain a raw mixture in mixing; and (2) filling the raw mixture into a tubular capsule installed around the roll shaft, then degassing the inside of the capsule, and then sintering the raw mixture by hot isostatic pressing under 70 to 120 MPa of pressure in hot isostatic pressing.

The mixing order of the powders and the fiber which are the raw materials is not limited as long as a sufficient mixing time is secured. For example, (b) the ceramic fiber may be mixed with a mixture of (a) the powder of the iron alloy and (c) the ceramic powder. Alternatively, (c) the ceramic powder may be mixed with a mixture of (a) the powder of the iron alloy and (b) the ceramic fiber.

Hereinafter, the above-described method for manufacturing will be described in detail.

For example, the outer layer of the composite rolling mill roll according to the present embodiment is manufactured by filling the raw mixture into a tubular soft steel capsule, mounting and welding a soft steel lid (to which a degassing pipe is connected) on the capsule to seal the capsule, degassing through the degassing pipe to vacuum seal, and then, sintering the raw mixture by hot isostatic pressing (HIP). The material of the capsule is a soft steel plate having about 2 to 10 mm of a thickness. The capsule is formed around the roll shaft such that the shape of the sintered body after hot isostatic pressing is a shape having a sufficient finishing allowance to be worked into a desired shape of the outer layer of the roll. In addition, the capsule shape is determined in consideration of the deformation of the sintered body during hot isostatic pressing. When the capsule is provided around the roll shaft to manufacture the composite rolling mill roll (that is, a simultaneous sintering method with the roll shaft), the roll shaft and the capsule are joined by welding or the like such that the powders and the fiber as the raw materials do not leak.

FIG. 1 is a diagram illustrating a simultaneous sintering method which uses hot isostatic pressing. A tubular iron capsule 2 is welded on an outer circumference of a roll shaft 1. A raw mixture 4 which is a mixture of the powder of the iron alloy, the ceramic fiber, and the ceramic powder is filled into a filling space formed by the roll shaft 1 and the capsule 2. A lid 3 is installed to the capsule 2. The periphery of the lid 3 is welded (welding portion 6). Degassing is performed (reference numeral 5 represents a degassing port). Vacuum sealing is performed, followed by hot isostatic pressing. The raw mixture 4 in the capsule 2 is sintered by hot isostatic pressing and is metallurgically joined with the roll shaft at the same time.

In order to obtain a composite rolling mill roll having a sufficient strength, it is necessary that the sinter forming of the outer layer be performed by hot isostatic pressing under 70 MPa or higher of a pressure. If a sufficient pressure is not applied, voids are initiated in the sintered body, and the strength of the outer layer (sintered body) is decreased. The lower limit of the pressure during hot isostatic pressing is preferably 85 MPa.

The upper limit of the pressure during hot isostatic pressing does not need to be limited. However, in consideration of facility capacity, the upper limit of the pressure during hot isostatic pressing is typically 120 MPa.

The sintered body formed with a sintering method may be treated with selecting heat treatment condition and polishing/grinding condition depending on the components of the powder of the iron alloy and the usage conditions of the roll such that the required hardness and the surface roughness are obtained.

The outer layer of the composite rolling mill roll according to the present embodiment, which is obtained using the above-described materials and the above-described method for manufacturing, includes a sintered body including a base metal which is an iron alloy, a fibrous inclusion which consists of a ceramic and has an average diameter of 1 to 30 μm and an average aspect ratio of 10 to 500, and a particulate inclusion which consists of a ceramic and has an average diameter of 1 to 100 μm. The amount of the fibrous inclusion is 5 to 40 volume % relative to a volume of the sintered body, and the amount of the particulate inclusion is 5 to 30 volume % relative to the volume of the sintered body.

The base metal which is the iron alloy is derived from the powder of the iron alloy, the fibrous inclusion is derived from the ceramic fiber, and the particulate inclusion is derived from the ceramic powder. The ceramic powder and the ceramic fiber exist independently in the sintered body as the particulate inclusion and the fibrous inclusion. Accordingly, the ceramic powder and the ceramic fiber do not form a compound with the powder of the iron alloy. Depending on the setting temperature during sintering, a compound may be formed, but the amount thereof is very small. Accordingly, the chemical compositions of the base metal, the fibrous inclusion, and the particulate inclusion are substantially the same as those of the powder of the iron alloy, the ceramic fiber, and the ceramic powder, respectively. Further, the shapes of the fibrous inclusion and the particulate inclusion are substantially the same as those of the ceramic fiber and the ceramic powder, respectively. Accordingly, the preferable shapes of the fibrous inclusion and the particulate inclusion are substantially the same as those of the ceramic fiber and the ceramic powder, respectively.

The chemical composition of the base metal of the sintered body of the composite rolling mill roll according to the present embodiment may include: 0.8 to 3.5 wt % of C; 1 to 13 wt % of Cr; 0 to 18 wt % of Mo; 0 to 28 wt % of W; 0 to 15 wt % of Ni; 0 to 18 wt % of Co; 2 to 20 wt % of one or more of elements in total, the elements being selected from a group consisting of V, Nb, Ti, Ta, Zr, and Hf, and a remainder including Fe and an impurity. More preferably, the chemical composition of the base metal of the sintered body of the composite rolling mill roll according to the present embodiment may include: 1.0 to 2.8 wt % of C; 2 to 10 wt % of Cr; 0 to 15 wt % of Mo; 0 to 20 wt % of W; 0 to 10 wt % of Ni; 0 to 15 wt % of Co; 3 to 15 wt % of one or more of elements selected from a group consisting of V, Nb, Ti, Ta, Zr, and Hf, and a remainder including Fe and an impurity. The particulate inclusion and the fibrous inclusion may be one or more of an oxide, a nitride, and a carbide. The particulate inclusion may be one or more of an alumina, a zirconia, a titania, a boron nitride, a silicon nitride, and a zirconium nitride. The fibrous inclusion may be one or more of the alumina, a mullite, the boron nitride, and the silicon nitride. Further, the shapes and the amounts of the ceramic fiber and the ceramic powder are substantially the same as those of the fibrous inclusion and the particulate inclusion, respectively. The total amount of the particulate inclusion and the fibrous inclusion according to the present embodiment may be 35 to 70 volume % relative to the volume of the sintered body. The effects of the present embodiment obtained by the above-described configurations are the same as the effects obtained by selecting the raw materials to obtain the above-described configurations.

The sintered body of the composite rolling mill roll includes the ceramic derived from the ceramic fiber and the ceramic powder and further includes the carbide derived from the powder of the iron alloy. The carbide exists in the sintered body as a mixture of carbides of the respective elements contained in the powder of the iron alloy. Accordingly, the ceramic derived from the ceramic fiber and the ceramic powder and the carbide derived from the powder of the iron alloy can be identified by analyzing the components thereof. Specifically, in a case where a target is analyzed with a device, such as EPMA, capable of local analysis, when the target is a ceramic which is a composite carbide including Fe, Cr, Mo, and W, the target can be identified as the carbide derived from the powder of the iron alloy. Typically, the average diameter of the carbide derived from the powder of the iron alloy is about 0.1 to 2 μm, but varies depending on the temperature and the time of hot isostatic pressing and the conditions of the subsequent heat treatment which is optionally performed.

(Rolling Method)

Using the composite rolling mill roll obtained in the present embodiment, a metal material can be rolled. That is, the composite rolling mill roll according to the present embodiment can be desirably used not only as a hot rolling mill roll for thin steel strip, but also as a tool for hot working such as seamless processing, wire rolling, hot pressing, or forging, a cold rolling mill roll for thin steel strip, and a tool for cold working. In addition, the composite rolling mill roll according to the present embodiment as a material having high wear resistance can be applied to rollers and guides surrounding a rolling mill.

EXAMPLES

Using raw materials and methods described below, various composite rolling mill rolls according to Examples and Comparative Examples were prepared, and properties thereof were evaluated.

(Used Raw Materials)

As the powder of the iron alloy, a powder including 2.1 wt % of C, 4.8 wt % of Cr, 6.0 wt % of V, 5.1 wt % of Mo, 4.5 wt % of W, 1.3 wt % of Si, 0.9 wt % of Mn, and a remainder substantially including Fe an impurity was used. As the average diameter of the powder of the iron alloy, several diameter were selected and used in a range of 0.5 to 125 μm. As the ceramic powder, an alumina powder, a SiC powder, a $B_4C$ powder, and a silicon nitride powder whose average diameter were selected in a range of 0.7 to 125 μm were used. As the ceramic fiber, an alumina fiber (average diameter: 0.8 to 3.6 μm, average aspect ratio: about 8 to 603), a silicon nitride fiber (average diameter: 10 μm, average aspect ratio: 105), a SiC fiber (average diameter: 8 μm, average aspect ratio: 89), and a $B_4C$ fiber (average diameter: 7 μm, average aspect ratio: 95 were used.

(Preparation of Composite Roll)

Using the above-described powders and fibers, composite rolling mill rolls (diameter: 110 mm, body length: 300 mm) were prepared according to the blending amounts shown in Tables 1 and 2. An iron capsule as a molding die was provided around a roll shaft (Cr—Mo steel). A raw mixture of the powder of the iron alloy, the ceramic powder, and the ceramic fiber shown in Tables 1 and 2 was filled into the capsule. The raw mixture of the powder of the iron alloy, the ceramic powder, and the ceramic fiber was obtained by sufficiently mixing the powder of the iron alloy with the ceramic powder and then further mixing the ceramic fiber therewith. The mixing was performed with a rotary ball mill. Next, a lid of the capsule was welded, and the inside of the capsule was degassed, followed by hot isostatic pressing at 1050° C. under 60 MPa to 120 MPa of a predetermined pressure. After cooling, the capsule was removed and a heat treatment of hardening and tempering under conditions close to heat treatment conditions for a tool material on which a composition is similar to the iron alloy component such that the Shore hardness was about 85 to 90.

(Hot Coil Rolling Experiment)

When 4000 m of rolled coil of common steel was rolled using each of the composite rolling mill rolls prepared as above in a hot coil rolling experiment, the depth of wear, the crack depth, and the surface roughness of the composite rolling mill roll were measured. The measurement methods are as follows.

Defects of sintered body: Whether or not defects occurred was checked by ultrasonic inspection. A sample where defects were observed was evaluated as "Bad".

Depth of wear: The depth of wear was measured from a difference of a roll profile before and after rolling. A sample where the depth of wear was greater than or equal to 15 μm was evaluated as "Bad".

Crack depth: The roll after rolling was cut to observe the vicinity of a roll surface, and the maximum depth of cracks was considered as the crack depth. A sample where the crack depth was greater than or equal to 100 μm was evaluated as "Bad".

Surface roughness: The arithmetic average roughness (center line average roughness) Ra was measured. The measurement method was performed according to JIS B0601. A sample where the surface roughness was greater than or equal to 0.8 μm Ra was evaluated as "Bad".

With the above-described measurement methods, the composite rolling mill rolls were evaluated. A sample which passed all the measurements was evaluated as a passed product (Good).

Hot coil rolling experiment conditions were 800° C. of a heating temperature, 100 m/min of a rolling speed, 1 kgf/mm$^2$ of a entry-side tension, 3 kgf/mm$^2$ of an exit-side tension, 43% to 46% of a rolling reduction, and no lubricating oil.

The results are shown in Tables 1 and 2.

TABLE 1

| | POWDER OF IRON ALLOY | | | | | CERAMIC POWDER | | |
|---|---|---|---|---|---|---|---|---|
| | AVERAGE | CERAMIC FIBER | | | | | AVERAGE | |
| Ex. No. | DIAMETER OF POWDER (μm) | TYPE | DIAMETER OF FIBER (μm) | ASPECT RATIO | BLENDING AMOUNT (Volume %) | TYPE | DIAMETER OF POWDER (μm) | BLENDING AMOUNT (Volume %) |
| Ex. 1 | 30 | ALUMINA FIBER | 7 | 93 | 20 | ALUMINA ($Al_2O_3$) | 30 | 20 |
| 2 | 30 | ALUMINA FIBER | 7 | 93 | 15 | ALUMINA ($Al_2O_3$) | 30 | 20 |
| 3 | 85 | ALUMINA FIBER | 7 | 93 | 20 | ALUMINA ($Al_2O_3$) | 30 | 20 |
| 4 | 10 | ALUMINA FIBER | 7 | 93 | 20 | ALUMINA ($Al_2O_3$) | 30 | 20 |
| 5 | 50 | ALUMINA FIBER | 7 | 93 | 20 | ALUMINA ($Al_2O_3$) | 50 | 20 |

TABLE 1-continued

| | | | | | | | | |
|---|---|---|---|---|---|---|---|---|
| 6 | 30 | ALUMINA FIBER | 7 | 93 | 20 | ALUMINA ($Al_2O_3$) | 15 | 20 |
| 7 | 30 | ALUMINA FIBER | 7 | 93 | 20 | ALUMINA ($Al_2O_3$) | 90 | 20 |
| 8 | 30 | ALUMINA FIBER | 7 | 93 | 20 | ALUMINA ($Al_2O_3$) | 60 | 25 |
| 9 | 25 | ALUMINA FIBER | 7 | 93 | 25 | ALUMINA ($Al_2O_3$) | 20 | 20 |
| 10 | 55 | ALUMINA FIBER | 7 | 93 | 20 | ALUMINA ($Al_2O_3$) | 20 | 20 |
| 11 | 30 | SILICON NITRIDE FIBER | 10 | 105 | 20 | ALUMINA ($Al_2O_3$) | 20 | 20 |
| 12 | 30 | SILICON NITRIDE FIBER | 10 | 105 | 20 | ALUMINA ($Al_2O_3$) | 20 | 20 |
| 13 | 30 | ALUMINA FIBER | 7 | 102 | 20 | ALUMINA ($Al_2O_3$) | 30 | 15 |
| 14 | 30 | ALUMINA FIBER | 7 | 102 | 31 | ALUMINA ($Al_2O_3$) | 30 | 20 |
| 15 | 30 | ALUMINA FIBER | 7 | 102 | 38 | ALUMINA ($Al_2O_3$) | 30 | 20 |
| 16 | 30 | ALUMINA FIBER | 7 | 102 | 15 | ALUMINA ($Al_2O_3$) | 30 | 20 |
| 17 | 30 | ALUMINA FIBER | 7 | 102 | 37 | ALUMINA ($Al_2O_3$) | 30 | 28 |
| 18 | 30 | ALUMINA FIBER | 7 | 102 | 20 | ALUMINA ($Al_2O_3$) | 15 | 20 |
| 19 | 30 | ALUMINA FIBER | 7 | 102 | 20 | ALUMINA ($Al_2O_3$) | 15 | 20 |
| 20 | 30 | ALUMINA FIBER | 7 | 102 | 20 | SILICON NITRIDE ($Si_3N_4$) | 15 | 20 |
| 21 | 30 | ALUMINA FIBER | 7 | 93 | 20 | ZIRCONIA (ZrO) | 20 | 20 |
| 22 | 30 | ALUMINA FIBER | 7 | 93 | 20 | TITANIA ($TiO_2$) | 17 | 15 |

| | TOTAL BLENDING AMOUNT | HIP CONDITIONS | | | RESULT OF HOT COIL ROLLING EXPERIMENT | | | |
|---|---|---|---|---|---|---|---|---|
| Ex. No. | OF CERAMIC FIBER AND CERAMIC POWDER | HEATING TEMPERATURE (° C.) | PRESSURE (MPa) | DEFECT EXISTENCE | WEAR DEPTH (μm) | CRACK DEPTH (μm) | SURFACE ROUGHNESS (μm Ra) | PASS/ FAIL |
| Ex. 1 | 40 | 1050 | 100 | NONE | 8 | 88 | 0.35 | GOOD |
| 2 | 35 | 1050 | 100 | NONE | 9 | 85 | 0.39 | GOOD |
| 3 | 40 | 1050 | 100 | NONE | 8 | 85 | 0.41 | GOOD |
| 4 | 40 | 1050 | 100 | NONE | 9 | 89 | 0.37 | GOOD |
| 5 | 40 | 1050 | 100 | NONE | 8 | 86 | 0.37 | GOOD |
| 6 | 40 | 1050 | 100 | NONE | 8 | 87 | 0.38 | GOOD |
| 7 | 40 | 1050 | 100 | NONE | 7 | 90 | 0.34 | GOOD |
| 8 | 45 | 1050 | 100 | NONE | 8 | 89 | 0.34 | GOOD |
| 9 | 45 | 1050 | 100 | NONE | 7 | 80 | 0.33 | GOOD |
| 10 | 40 | 1050 | 100 | NONE | 8 | 83 | 0.34 | GOOD |
| 11 | 40 | 1050 | 100 | NONE | 9 | 84 | 0.35 | GOOD |
| 12 | 40 | 1050 | 100 | NONE | 7 | 81 | 0.32 | GOOD |
| 13 | 35 | 1050 | 100 | NONE | 9 | 86 | 0.41 | GOOD |
| 14 | 51 | 1050 | 100 | NONE | 6 | 82 | 0.3 | GOOD |
| 15 | 58 | 1050 | 100 | NONE | 6 | 81 | 0.28 | GOOD |
| 16 | 35 | 1050 | 100 | NONE | 9 | 89 | 0.4 | GOOD |
| 17 | 65 | 1050 | 100 | NONE | 5 | 78 | 0.26 | GOOD |
| 18 | 40 | 950 | 100 | NONE | 9 | 88 | 0.38 | GOOD |
| 19 | 40 | 1050 | 75 | NONE | 10 | 91 | 0.43 | GOOD |
| 20 | 40 | 1050 | 100 | NONE | 8 | 87 | 0.38 | GOOD |
| 21 | 40 | 1050 | 100 | NONE | 9 | 89 | 0.4 | GOOD |
| 22 | 35 | 1050 | 100 | NONE | 10 | 88 | 0.41 | GOOD |

TABLE 2

| | POWDER OF IRON ALLOY | CERAMIC FIBER | | | | CERAMIC POWDER | | |
|---|---|---|---|---|---|---|---|---|
| Comp. Ex. No. | AVERAGE DIAMETER OF POWDER (μm) | TYPE | DIAMETER OF FIBER (μm) | ASPECT RATIO | BLENDING AMOUNT (Volume %) | TYPE | AVERAGE DIAMETER OF POWDER (μm) | BLENDING AMOUNT (Volume %) |
| Comp. Ex. 1 | 50 | ALUMINA FIBER | 7 | 102 | 20 | — | — | 0 |
| 2 | 50 | ALUMINA FIBER | 7 | 102 | 20 | ALUMINA ($Al_2O_3$) | 30 | 40 |
| 3 | 50 | ALUMINA FIBER | 7 | 102 | 20 | ALUMINA ($Al_2O_3$) | 30 | 2 |
| 4 | 50 | ALUMINA FIBER | 7 | 93 | 3 | ALUMINA ($Al_2O_3$) | 30 | 15 |
| 5 | 50 | ALUMINA FIBER | 7 | 93 | 45 | ALUMINA ($Al_2O_3$) | 30 | 20 |
| 6 | 30 | ALUMINA FIBER | 7 | 93 | 20 | ALUMINA ($Al_2O_3$) | 15 | 20 |
| 7 | 35 | ALUMINA FIBER | 7 | 93 | 50 | — | — | 0 |
| 8 | 30 | SILICON CARBIDE FIBER | 8 | 89 | 20 | ALUMINA ($Al_2O_3$) | 20 | 20 |
| 9 | 30 | BORON CARBIDE FIBER | 7 | 95 | 20 | ALUMINA ($Al_2O_3$) | 20 | 20 |
| 10 | 30 | ALUMINA FIBER | 7 | 93 | 20 | SILICON CARBIDE | 20 | 20 |
| 11 | 30 | ALUMINA FIBER | 7 | 93 | 20 | BORON CARBIDE | 20 | 20 |
| 12 | 30 | ALUMINA FIBER | 0.8 | 98 | 20 | ALUMINA ($Al_2O_3$) | 20 | 20 |
| 13 | 30 | ALUMINA FIBER | 36 | 84 | 20 | ALUMINA ($Al_2O_3$) | 20 | 20 |

TABLE 2-continued

| | | | | | | | | |
|---|---|---|---|---|---|---|---|---|
| 14 | 30 | ALUMINA FIBER | 8 | 8 | 20 | ALUMINA ($Al_2O_3$) | 20 | 20 |
| 15 | 30 | ALUMINA FIBER | 6 | 603 | 20 | ALUMINA ($Al_2O_3$) | 20 | 20 |
| 16 | 30 | ALUMINA FIBER | 7 | 102 | 20 | ALUMINA ($Al_2O_3$) | 0.7 | 20 |
| 17 | 30 | ALUMINA FIBER | 7 | 102 | 20 | ALUMINA ($Al_2O_3$) | 125 | 20 |

| Comp. Ex. No. | TOTAL BLENDING AMOUNT OF CERAMIC FIBER AND CERAMIC POWDER | HIP CONDITIONS HEATING TEMPERATURE (° C.) | HIP CONDITIONS PRESSURE (MPa) | DEFECT EXISTENCE | RESULT OF HOT COIL ROLLING EXPERIMENT WEAR DEPTH (μm) | RESULT OF HOT COIL ROLLING EXPERIMENT CRACK DEPTH (μm) | RESULT OF HOT COIL ROLLING EXPERIMENT SURFACE ROUGHNESS (μm Ra) | PASS/FAIL |
|---|---|---|---|---|---|---|---|---|
| Comp. Ex. 1 | 20 | 1050 | 100 | NONE | 16 | 94 | 0.98 | BAD |
| 2 | 60 | 1050 | 100 | NONE | 6 | 145 | 0.56 | BAD |
| 3 | 22 | 1050 | 100 | NONE | 20 | 92 | 0.81 | BAD |
| 4 | 18 | 1050 | 100 | NONE | 25 | 179 | 1.13 | BAD |
| 5 | 65 | 1050 | 100 | OCCURRED | 43 | 387 | 9.25 | BAD |
| 6 | 40 | 1050 | 60 | OCCURRED | 36 | 278 | 6.61 | BAD |
| 7 | 50 | 1050 | 100 | OCCURRED | 51 | 418 | 9.89 | BAD |
| 8 | 40 | 1050 | 100 | NONE | 15 | 98 | 0.77 | BAD |
| 9 | 40 | 1050 | 100 | NONE | 13 | 97 | 0.8 | BAD |
| 10 | 40 | 1050 | 100 | NONE | 15 | 97 | 0.81 | BAD |
| 11 | 40 | 1050 | 100 | NONE | 14 | 101 | 0.78 | BAD |
| 12 | 40 | 1050 | 100 | OCCURRED | 38 | 175 | 3.93 | BAD |
| 13 | 40 | 1050 | 100 | NONE | 13 | 91 | 6.87 | BAD |
| 14 | 40 | 1050 | 100 | NONE | 9 | 141 | 1.28 | BAD |
| 15 | 40 | 1050 | 100 | OCCURRED | 39 | 164 | 4.53 | BAD |
| 16 | 40 | 1050 | 100 | OCCURRED | 26 | 183 | 0.85 | BAD |
| 17 | 40 | 1050 | 100 | NONE | 11 | 201 | 0.68 | BAD |

Since Comparative Examples 1 to 17 were out of the limited ranges according to the present invention, the depth of wear, the crack depth, and/or the surface roughness was decreased.

Contrary to Comparative Examples, in Examples which were manufactured within the limited ranges according to the present invention, the wear resistance was high and defects such as voids caused by aggregation which was likely to occur during sinter forming did not occur. Further, in Examples, the surface roughness of the roll after rolling was small, the resistance of deterioration for roll surface was satisfactory, and the crack propagation depth was small. That is, in Examples, as compared to the techniques of the related art, the tribological properties such as wear resistance and resistance of deterioration for roll surface can be improved while maintaining and improving the mechanical properties. In addition, the following was found: when the blending amount of the alumina fiber was greater than the limited blending amount according to the present invention, defects occurred during manufacturing; and when the blending amount of the ceramic fiber was less than the limited blending amount according to the present invention, the effects of improving the wear resistance and the resistance of deterioration for roll surface were not able to be obtained. It was found that, when the blending amounts of the ceramic fiber and the ceramic powder were increased within the ranges according to the present invention, the composite rolling mill roll exhibited higher performance.

It can be seen from the above-described results that, by using the composite rolling mill roll according to the present invention, the wear resistance can be significantly improved, the surface roughness can be maintained at a low level, the resistance of deterioration for roll surface can be improved, and the crack depth can be maintained at the same level as that of a FRM roll of the related art.

INDUSTRIAL APPLICABILITY

According to the composite rolling mill roll of the present invention, as compared to a FRM roll of the related art, the wear resistance and the resistance of deterioration for roll surface can be improved, and the accident resistance can be maintained at the same level. As a result, the replacement cycle of the composite rolling mill roll can be significantly increased, and not only improvement in unit consumption of a roll but improvement in productivity and yield can be expected.

BRIEF DESCRIPTION OF THE REFERENCE SYMBOLS

1: ROLL SHAFT
2: CAPSULE
3: LID
4: RAW MIXTURE
5: DEGASSING PORT
6: WELDING PORTION
S1: MIXING
S2: HOT ISOSTATIC PRESSING

The invention claimed is:

1. A composite rolling mill roll comprising:
a steel roll shaft; and
an outer layer provided around the roll shaft, wherein
the outer layer includes a sintered body including a base metal which is an iron alloy, a fibrous inclusion which consists of a ceramic and has an average diameter of 1 to 30 μm and an average aspect ratio of 10 to 500, and a particulate inclusion which consists of a ceramic and has an average diameter of 1 to 100 μm,
an amount of the fibrous inclusion is 5 to 40 volume % relative to a volume of the sintered body, and
an amount of the particulate inclusion is 5 to 30 volume % relative to the volume of the sintered body.

2. The composite rolling mill roll according to claim 1, wherein
a chemical composition of the base metal of the sintered body comprises:
0.8 to 3.5 wt % of C;
1 to 13 wt % of Cr;

0 to 18 wt % of Mo;
0 to 28 wt % of W;
0 to 15 wt % of Ni;
0 to 18 wt % of Co;
2 to 20 wt % of one or more of elements in total, the elements being selected from a group consisting of V, Nb, Ti, Ta, Zr, and Hf; and
a remainder including Fe and an impurity.

3. The composite rolling mill roll according to claim 1, wherein
the particulate inclusion and the fibrous inclusion are one or more of an oxide, a nitride, and a carbide.

4. The composite rolling mill roll according to claim 3, wherein
the particulate inclusion is one or more of an alumina, a zirconia, a titania, a boron nitride, a silicon nitride, and a zirconium nitride.

5. The composite rolling mill roll according to claim 3, wherein
the fibrous inclusion is one or more of the alumina, a mullite, the boron nitride, and the silicon nitride.

6. The composite rolling mill roll according to claim 1, wherein
a total amount of the particulate inclusion and the fibrous inclusion is 35 to 70 volume % relative to the volume of the sintered body.

7. A composite rolling mill roll comprising:
a steel roll shaft; and
an outer layer provided around the roll shaft, wherein
the outer layer includes a sintered body obtained by sintering a mixture of (a) a powder of an iron alloy, (b) a ceramic fiber which has an average diameter of 1 to 30 μm and an average aspect ratio of 10 to 500, and (c) a ceramic powder which has an average diameter of 1 to 100 μm;
a blending amount of (b) the ceramic fiber before the sintering is 5 to 40 volume % relative to a total amount of (a) the powder of the iron alloy, (b) the ceramic fiber, and (c) the ceramic powder before the sintering;
a blending amount of (c) the ceramic powder before the sintering is 5 to 30 volume % relative to the total amount of (a) the powder of the iron alloy, (b) the ceramic fiber, and (c) the ceramic powder before the sintering; and
(b) the ceramic fiber and (c) the ceramic powder exist independently after the sintering.

8. The composite rolling mill roll according to claim 7, wherein
a chemical composition of (a) the powder of the iron alloy before the sintering comprises:
0.8 to 3.5 wt % of C;
1 to 13 wt % of Cr;
0 to 18 wt % of Mo;
0 to 28 wt % of W;
0 to 15 wt % of Ni;
0 to 18 wt % of Co;
2 to 20 wt % of one or more of elements in total, the elements being selected from a group consisting of V, Nb, Ti, Ta, Zr, and Hf; and
a remainder including Fe and an impurity.

9. The composite rolling mill roll according to claim 7, wherein
(c) the ceramic powder is one or more of an oxide, a nitride, and a carbide.

10. The composite rolling mill roll according to claim 9, wherein
(c) the ceramic powder is one or more of an alumina, a zirconia, a titania, a boron nitride, a silicon nitride, and a zirconium nitride.

11. The composite rolling mill roll according to claim 7, wherein
(b) the ceramic fiber is one or more of an oxide-type fiber, a carbide-type fiber, and a nitride-type fiber.

12. The composite rolling mill roll according to claim 7, wherein
a total blending amount of (b) the ceramic fiber and (c) the ceramic powder before the sintering is 35 to 70 volume % relative to the total amount of (a) the powder of the iron alloy, (b) the ceramic fiber, and (c) the ceramic powder before the sintering.

13. A method for rolling comprising:
rolling a metallic material with the composite rolling mill roll according to claim 1.

14. A method for manufacturing a composite rolling mill roll including an outer layer and a roll shaft, the method comprising:
mixing a powder of an iron alloy, a ceramic powder having an average diameter of 1 to 100 μm, and a ceramic fiber having an average diameter of 1 to 30 μm and an average aspect ratio of 10 to 500 to obtain a raw mixture; and
filling the raw mixture into a tubular capsule installed around the roll shaft, then degassing inside of the capsule, and then sintering the raw mixture by hot isostatic pressing under 70 to 120 MPa of a pressure to obtain the composite rolling mill roll in which the outer layer is joined around the roll shaft; wherein
a blending amount of the ceramic fiber before the sintering is 5 to 40 volume % relative to the total amount of the raw mixture before the sintering; and
a blending amount of the ceramic powder before the sintering is 5 to 30 volume % relative to the total amount of the raw mixture before the sintering.

15. A method for rolling comprising:
rolling a metallic material with the composite rolling mill roll according to claim 7.

16. The composite rolling mill roll according to claim 1, wherein
the particulate inclusion is an oxide or a nitride.

17. The composite rolling mill roll according to claim 1, wherein
the fibrous inclusion is one or more of an oxide excluding an alumina and a mullite, a nitride, and a carbide.

18. The composite rolling mill roll according to claim 7, wherein
(c) the ceramic powder is an oxide or a nitride.

19. The composite rolling mill roll according to claim 7, wherein
(b) the ceramic fiber is one or more of an oxide-type fiber excluding an alumina and a mullite, a carbide-type fiber, and a nitride-type fiber.

20. The method for manufacturing a composite rolling mill roll including an outer layer and a roll shaft according to claim 14, wherein
the ceramic powder is an oxide or a nitride.

21. The method for manufacturing a composite rolling mill roll including an outer layer and a roll shaft according to claim 14, wherein
the ceramic fiber is one or more of an oxide-type fiber excluding an alumina and a mullite, a carbide-type fiber, and a nitride-type fiber.

* * * * *